US006276450B1

(12) United States Patent
Seneviratne

(10) Patent No.: US 6,276,450 B1
(45) Date of Patent: Aug. 21, 2001

(54) APPARATUS AND METHOD FOR RAPID REPLACEMENT OF UPPER BLOWOUT PREVENTERS

(75) Inventor: Padmasiri Daya Seneviratne, Fullerton, CA (US)

(73) Assignee: Varco International, Inc., Orange, CA (US)

( * ) Notice: Subject to any disclaimer, the term of this patent is extended or adjusted under 35 U.S.C. 154(b) by 0 days.

(21) Appl. No.: 09/364,747

(22) Filed: Jul. 30, 1999

Related U.S. Application Data

(60) Provisional application No. 60/132,140, filed on May 2, 1999.

(51) Int. Cl.[7] ..... E21B 19/00

(52) U.S. Cl. ..... 166/85.1; 166/85.4; 166/77.52; 166/77.53; 175/85

(58) Field of Search ..... 166/77.51, 77.52, 166/85.4, 84.3, 85.3, 378, 379, 380; 175/85, 113, 122, 162, 203

(56) References Cited

U.S. PATENT DOCUMENTS 4,449,596 5/1984 Boyadjieff .
4,535,852 8/1985 Boyadjieff et al. .
4,813,493 * 3/1989 Shaw et al. ..... 166/77.5
5,388,651 * 2/1995 Berry ..... 175/85
5,921,329 * 7/1999 Armstrong ..... 175/57

* cited by examiner

*Primary Examiner*—William Neuder
(74) *Attorney, Agent, or Firm*—Christie, Parker & Hale, LLP

(57) ABSTRACT

Apparatus and method for rapid replacement of upper inside blowout preventers (IBOP) on a top drive system (TDS) utilizes a hydraulic pressure booster to increase the operating pressure of a pipe handler/torque wrench, an air amplifier to increase the air pressure to a main shaft brake of the TDS in order to provide torque back-up, a rotary table back-up structure (RTBS) for providing a torque back-up for removing the upper IBOP, and a drive ring for preventing relative rotation between the RTBS and upper IBOP. The saver sub and lower IBOP are first broken out, or loosened, with the pipe handler/torque wrench. The upper IBOP is then broken out by placing the RTBS over the rotary table with the rotary table and the TDS main shaft locked. The modified TDS and pipe handler/torque wrench are then used together with the RTBS and drive ring in order to rapidly and safely replace the upper IBOP.

20 Claims, 12 Drawing Sheets

FIG. 7A
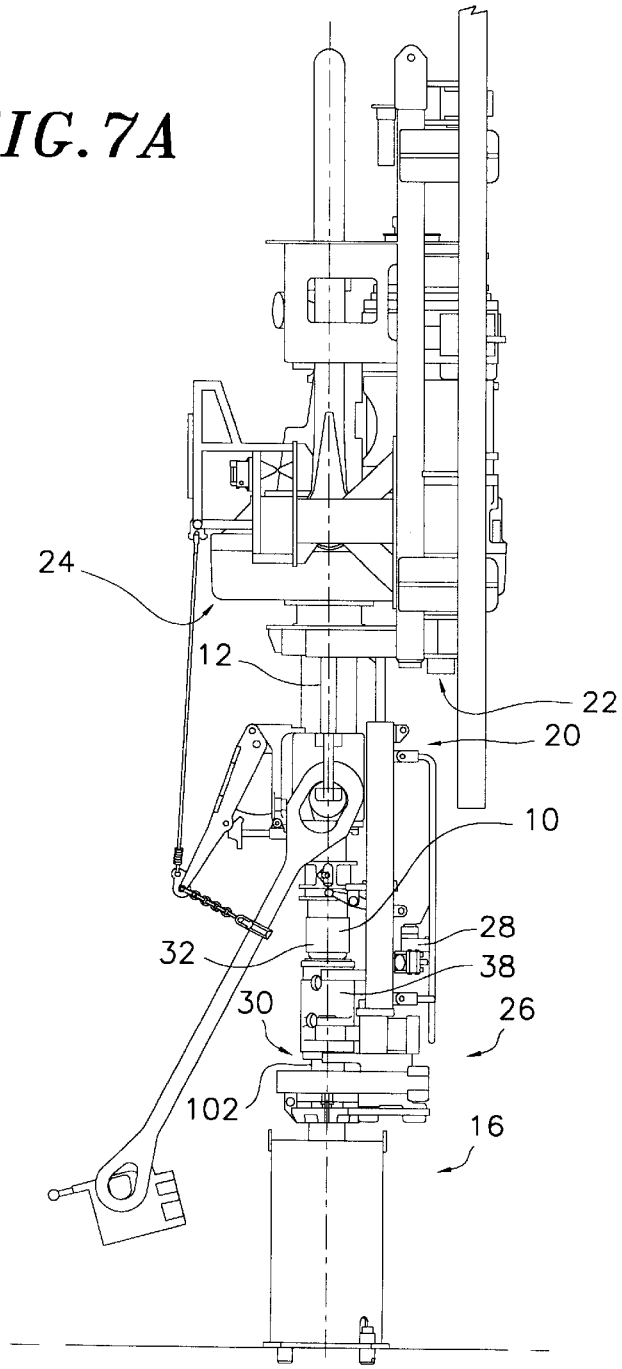
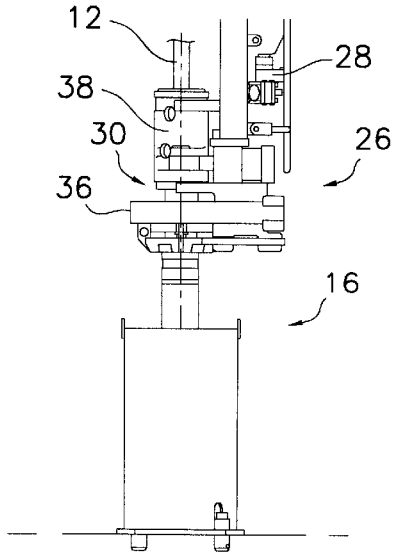
FIG. 7B

FIG. 11A
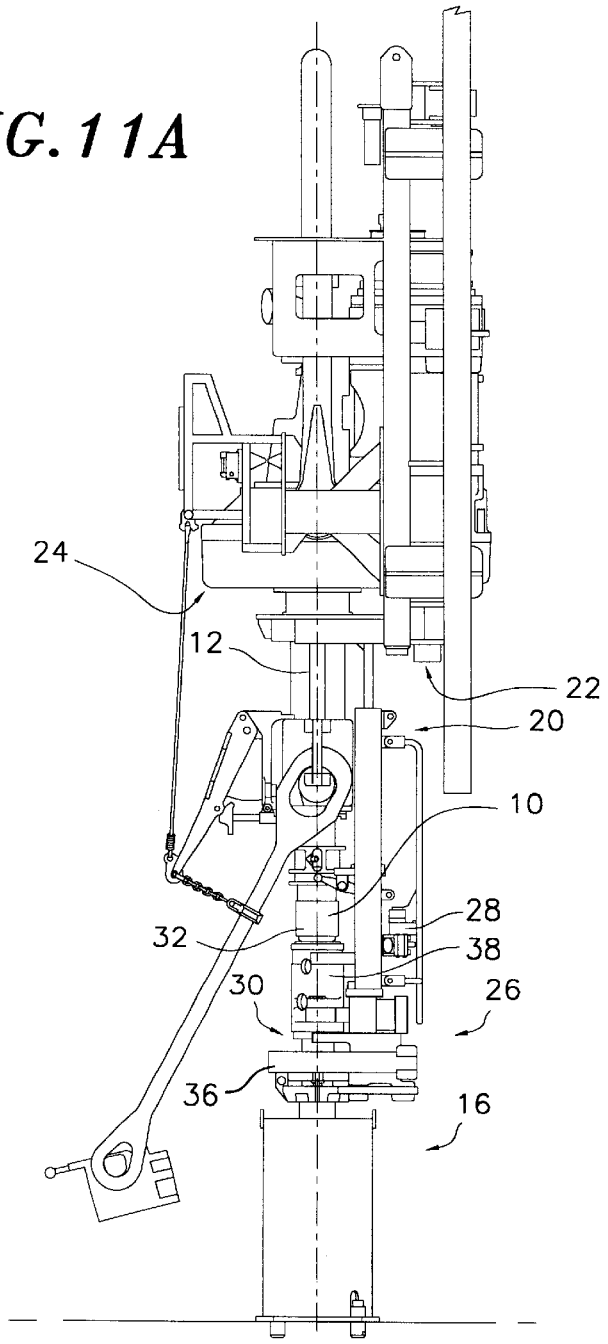
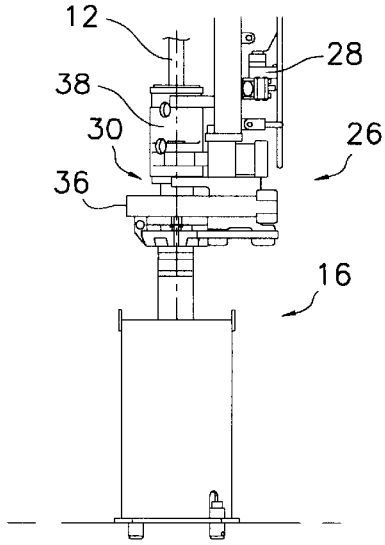
FIG. 11B

APPARATUS AND METHOD FOR RAPID REPLACEMENT OF UPPER BLOWOUT PREVENTERS

This application claims the benefit of U.S. Provisional Application No. 60/132,140, filed May 2, 1999.

BACKGROUND OF THE INVENTION

The drilling of oil wells has traditionally been dangerous and labor intensive, due in part to the potential for blowouts. A "blowout", which is an uncontrolled eruption of gas and oil from a well, is caused by a massive influx of formation fluid into the well bore at extremely high pressure. In many cases, blowouts occur at pressures sufficiently high to damage rig equipment and injure rig personnel. Blowout preventers (BOP's) are valves placed on top of a well to prevent blowouts. U.S. Pat. No. 4,535,852 to Boyadjieff and Krasnov describes the use of a blowout preventer valve in a top drive drilling system and is incorporated by reference in its entirety into the present disclosure.

Top drive drilling systems (TDS's) rotate the upper end of a drill string directly by a drive system suspended from a traveling block, rather than using a traditional rotary table and kelly. U.S. Pat. No. 4,449,596 to Boyadjieff describes a TDS and is incorporated by reference in its entirety into the present disclosure. Two IBOP's (Inside Blowout Preventers) and a saver sub are typically threadedly connected to the drive shaft of a TDS. For example, often an upper IBOP can be threaded to the drive shaft, a lower IBOP can be threaded to the upper IBOP, and a saver sub can be threaded to the lower IBOP. The drill string is then threaded onto the saver sub. Thus, rotational motion is transferred from the drive shaft of the TDS, down through the upper IBOP, the lower IBOP and the saver sub, to the drill string.

The threaded connections between the drive shaft of a TDS, an upper IBOP, a lower IBOP, a saver sub and a drill string, must be torqued to a high level in order to survive the forces encountered in a conventional drilling operation, with the higher components being torqued significantly tighter than the lower components. Thus, these components are typically too tight to rely on the torque provided by a conventional TDS to break the connections. To provide the required high torques, U.S. Pat. No. 4,449,596 describes a special torque wrench, or "pipe handler", that provides additional force for making and breaking these tight connections. Such torque wrenches work well for "breaking out", or loosening, and "making up", or tightening, the connections between the upper IBOP, the lower IBOP, the saver sub and the drill string, but have not been able to be used for breaking out the upper IBOP. The problem is that the torque wrench has no way of reaching the main shaft of the TDS in order to keep it from rotating while applying torque to the upper IBOP.

In order to prevent blowouts, IBOP's are tested frequently to make sure they hold pressure. On average, a problem is found with an IBOP every two to three months, leading to its replacement. Traditionally, upper IBOP's have been removed manually using modified tong hangers which can weigh as much as 600 pounds. The hangers are taken off and the tongs are picked up with tugger lines. During this process, several strong people are required to hold the tongs level so they can bite into the upper IBOP and the main drive shaft of the TDS. Extreme lateral forces are exerted on the tongs, potentially causing them to break and injure the workers using them. This manual procedure takes an average of eight to ten hours of dangerous, difficult and frustrating labor. Clearly, it would greatly improve safety and efficiency if an automated method for replacing the upper IBOP could be provided.

SUMMARY OF THE INVENTION

An apparatus and method for the rapid replacement of upper blowout preventers of the present invention allows for safe and rapid replacement of the upper IBOP. The present invention provides modifications to existing TDS and pipe handler/torque wrench systems (for example, the torque wrench described in U.S. Pat. No. 4,449,596) by providing a hydraulic pressure booster to increase the operating pressure of the pipe handler/torque wrench, an air amplifier to increase the air pressure to the TDS main shaft brake in order to immobilize the shaft temporarily, a drive ring, and a rotary table back-up structure (RTBS) for providing a torque back-up for removing the upper IBOP.

In the method of the present invention, the saver sub and lower IBOP are first broken out, or loosened, with the pipe handler/torque wrench and removed. The upper IBOP is then broken out by placing the RTBS over the rotary table with the rotary table and the TDS main shaft locked. The modified TDS and pipe handler/torque wrench are then used together with the RTBS and drive ring in order to rapidly and safely replace the upper IBOP.

To realize the advantages outlined above, one embodiment of the apparatus for rapid replacement of upper blowout preventers includes: a torque back-up structure engageable in a stationary relationship relative to the drill floor; a drive shaft brake adapted to substantially prevent rotation of the drive shaft; a torque wrench adapted to simultaneously grip the torque back-up structure and the drill string component; the torque wrench operable to apply torque to the drill string component relative to the backup structure to thereby turn the drill string component relative to the drive shaft; the torque back-up structure is secured to a rotary table of the drill floor; the drive shaft brake includes an air amplifier for increasing the pressure of a source of air pressure for substantially locking the drive shaft against the rotational force required to turn the drill string component relative to the drive shaft; the torque wrench is attached to a hydraulic pressure booster providing hydraulic pressure to the torque wrench to turn the drill string component; the drill string component is an upper IBOP; a drive ring engages the drill string component and the torque back-up structure in order to prevent relative rotational motion.

To realize the advantages outlined above, one embodiment of the method for rapid replacement of upper blowout preventers includes: positioning a torque back-up structure so as to stabilize the drill string component; locking a drive shaft using a drive shaft brake in order to prevent rotary motion of the drive shaft; utilizing a torque wrench to simultaneously grip the torque back-up structure and the drill string component; utilizing the torque wrench to apply torque to the drill string component and to turn the drill string component relative to the drive shaft; securing the torque back-up structure to a rotary table of a drilling rig; providing amplified air pressure produced by an air amplifier in order to substantially lock the drive shaft against the rotational force required to turn the drill string component relative to the locked drive shaft; providing hydraulic pressure to the torque wrench in order to turn the drill string component, wherein the hydraulic pressure is produced by a hydraulic pressure booster; the drill string component is an upper IBOP.

Other features and advantages of the present invention will be apparent from the following detailed description when read in conjunction with the accompanying drawings.

BRIEF DESCRIPTION OF THE DRAWINGS

In the drawings, which constitute part of this specification, embodiments demonstrating various features of the invention are set forth as follows:

FIG. 7A is a side elevational view of the TDS and pipe handler of FIG. 6 with the torque wrench stabbed onto the RTBS.

FIG. 7B is a partial side elevational view of the pipe handler and RTBS of FIG. 6 with the pipe handler raised so that the torque tube engages the upper IBOP and the lower gripping section of the torque wrench grips the RTBS.

FIG. 11A is a side elevational view of the TDS, pipe handler and RTBS of FIG. 6 with the drive ring removed and the TDS and pipe handler lowered so as to stab the new upper IBOP onto the RTBS.

FIG. 11B is a partial side elevational view of the pipe handler and RTBS of FIG. 6 with the pipe handler raised so that the torque tube engages new upper IBOP and so that the lower gripping section of the torque wrench grips the RTBS.

DETAILED DESCRIPTION OF THE PREFERRED EMBODIMENTS

Although detailed illustrative embodiments are disclosed herein, other suitable structures and machines for practicing the invention may be employed and will be apparent to persons of ordinary skill in the art. Consequently, specific structural and functional details disclosed herein are representative only; they describe the preferred embodiments of the invention.

Figure 6:
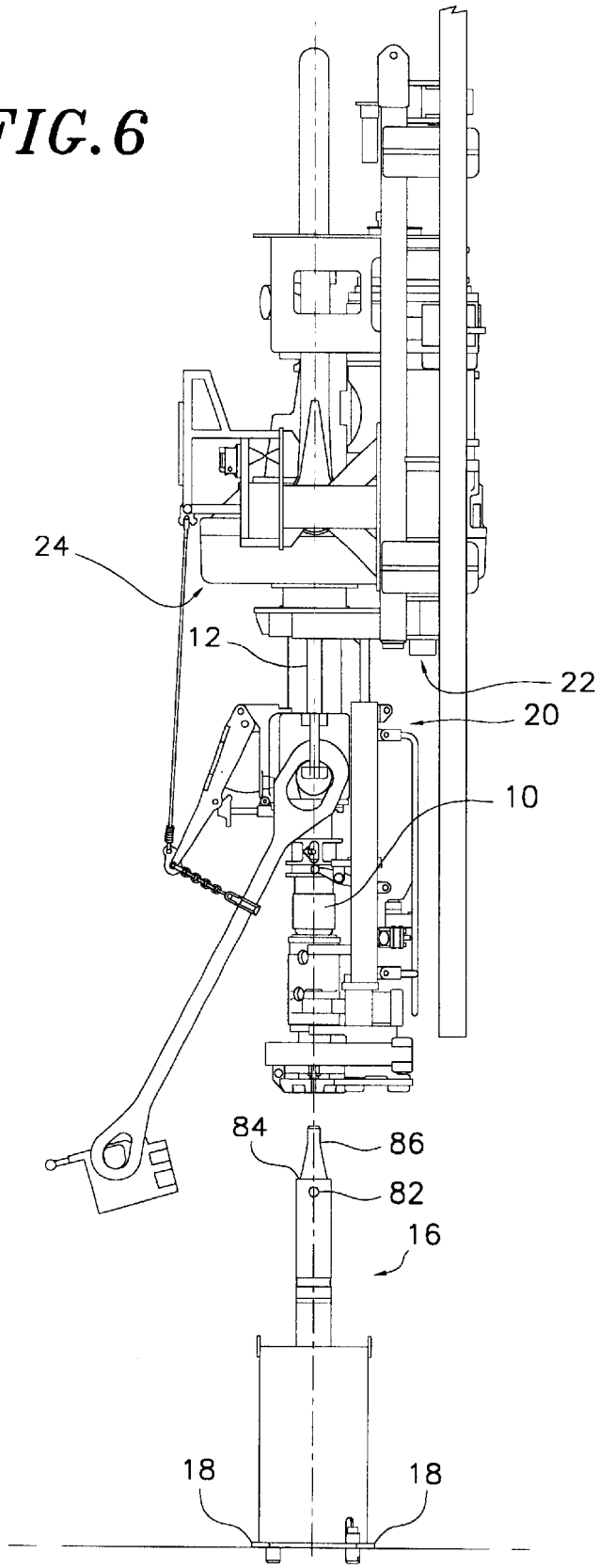
FIG. 6 is a side elevational view of the TDS and pipe handler of FIG. 1 positioned over the Rotary Table Back-Up Structure ("RTBS").
Figure 8:
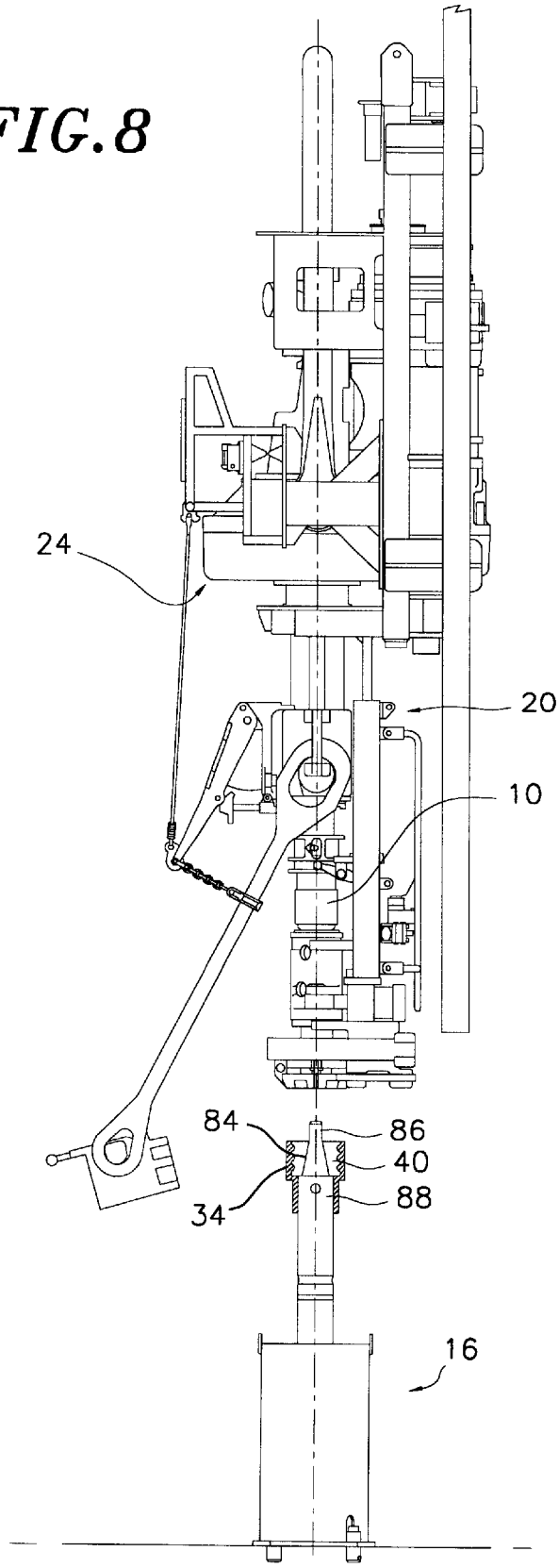
FIG. 8 is a side elevational view of the TDS, pipe handler and RTBS of FIG. 6, with the drive ring disposed over the RTBS.
Figure 9:
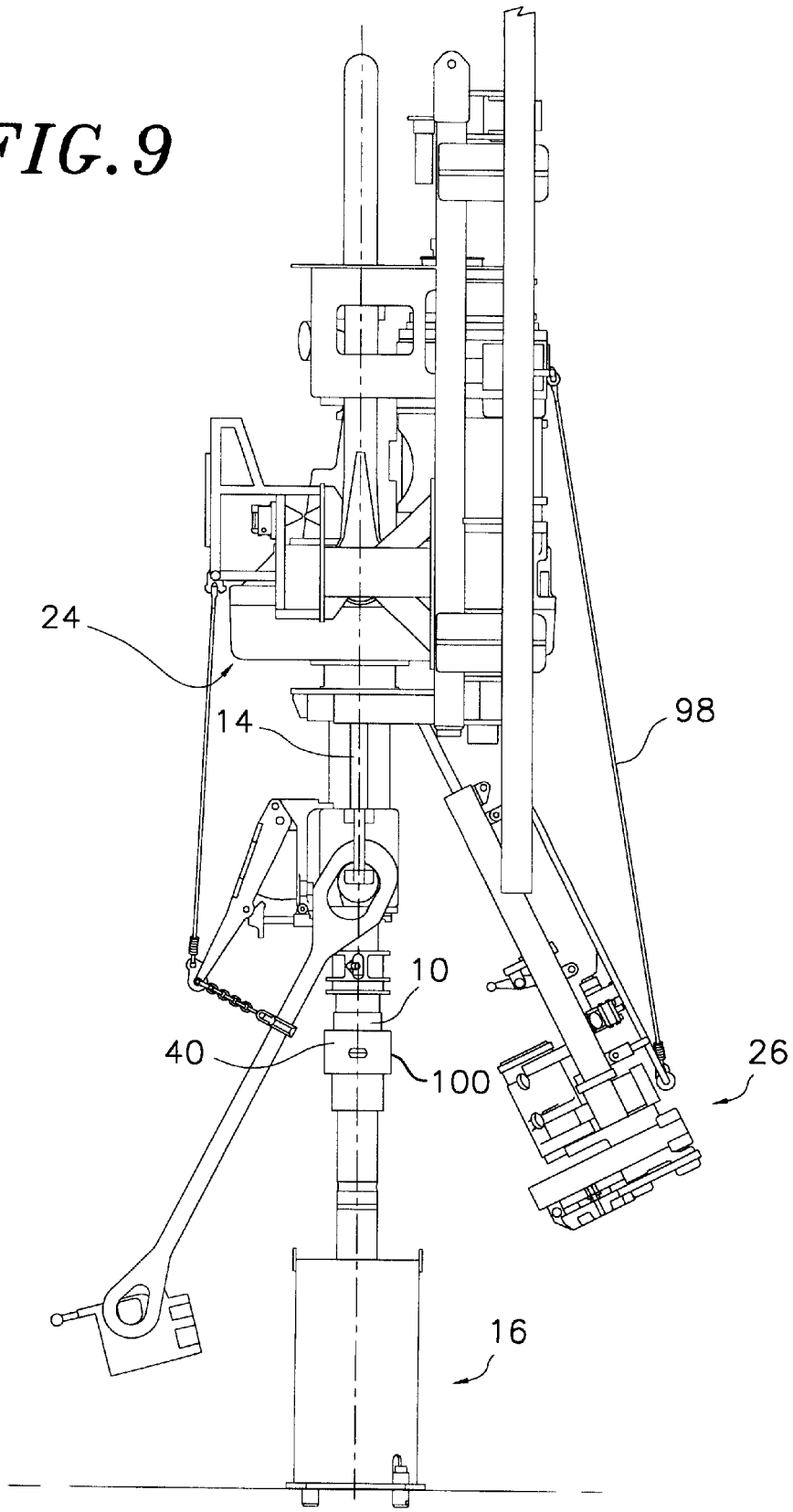
FIG. 9 is a side elevational view of the TDS, pipe handler and RTBS of FIG. 6, with the torque wrench swung back and tied up with a cable and with the TDS lowered so that the upper IBOP is fit into the drive ring and ready to be spun out by rotating the drive shaft.
Figure 10:
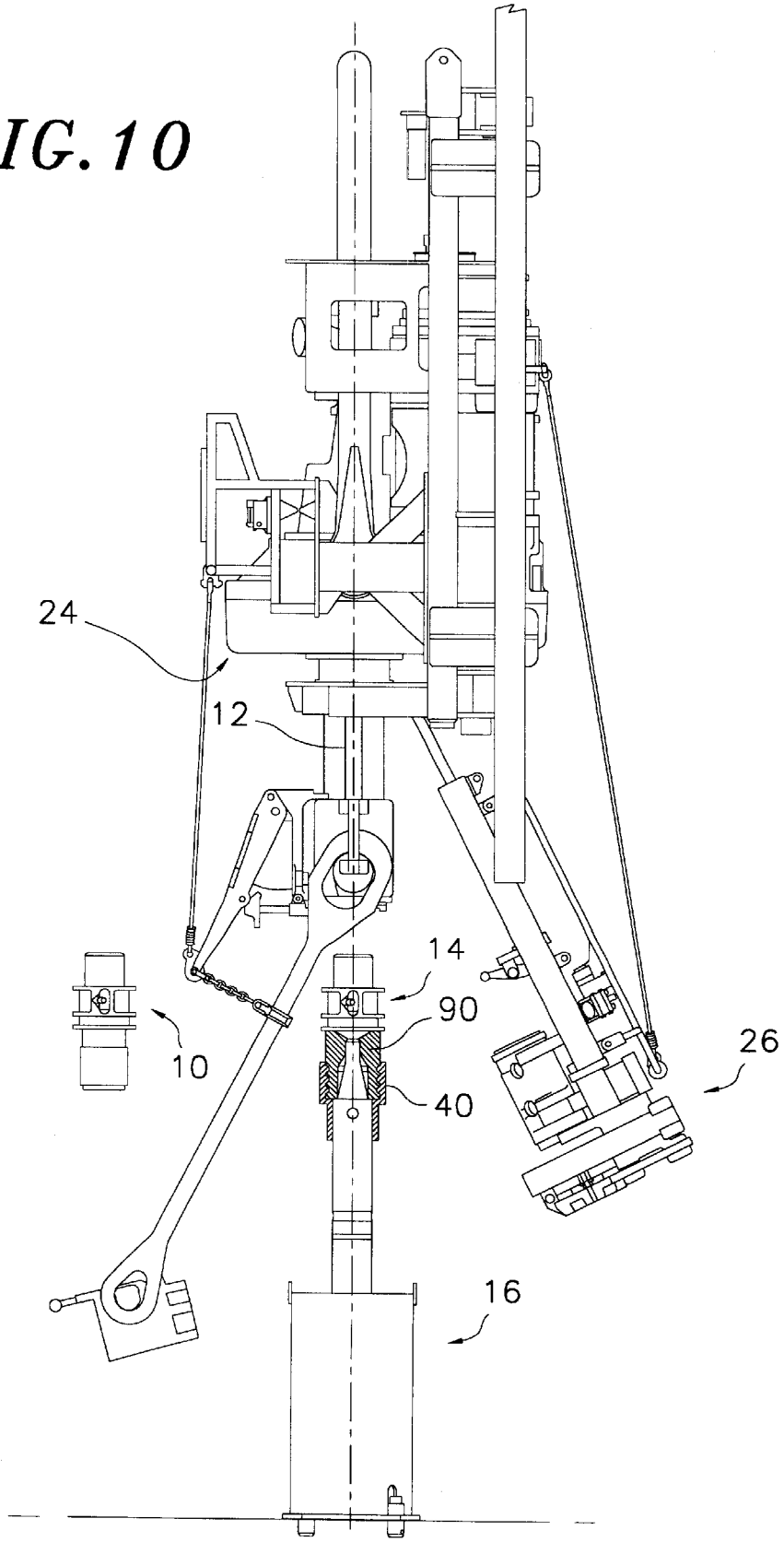
FIG. 10 is a side elevational view of the TDS, pipe handler and RTBS of FIG. 6 with the original IBOP removed and a new upper IBOP placed over the RTBS and drive ring.

Referring first to FIGS. 1 and 6–13, a system according to one embodiment of the present invention is constructed to remove an upper IBOP 10 from a TDS (top drive system) main drive shaft or "output shaft" 12, and replace it with a new upper IBOP 14. In doing so, an RTBS 16 is locked onto a rotary table 18, directly below the upper IBOP 10 and a pipe handler 20 (FIG. 6). An air amplifier 22 is then activated to lock the TDS drive shaft 12 against rotational movement, after which TDS 24 and the pipe handler 20 are lowered, stabbing the attached upper IBOP 10 onto the RTBS 16 (FIG. 7A). A torque wrench 26, utilizing a hydraulic pressure booster 28 to provide increased hydraulic pressure, is then activated to break out, or loosen, the upper IBOP 10 from the TDS drive shaft 12. In the process, the torque wrench 26 rises up so that an internal splined surface 30 of the torque tube (FIG. 3) engages an externally splined surface of the upper IBOP, and a lower gripping section 36 of the torque wrench 26 grips the RTBS 16. With the RTBS 16 and the locked TDS drive shaft 12 serving as torque back-ups, the torque tube 38 is rotated utilizing the increased hydraulic pressure to break out the upper IBOP 10 (FIG. 7B). After breaking out the upper IBOP 10, the TDS 24 and pipe handler 20 are raised, lifting the upper IBOP 10 off of the RTBS 16. A drive ring ring 40 is then placed over the RTBS 16 (FIG. 8), the torque wrench 26 is swung back, and the TDS 24 is lowered back down so that the drive ring drive pins 34 engage the splined external surface of the upper IBOP 10. The drive shaft 12 is then unlocked and the TDS 24 is used to spin out the upper IBOP 10 from the drive shaft 12 (FIG. 9). The TDS 24 is again raised, leaving the upper IBOP 10 resting in the drive ring 40. The upper IBOP 10 is then removed and a new upper IBOP 14 is placed into the drive ring 40 (FIG. 10). Next, the TDS 24 is used to spin the drive shaft 12 into the new upper IBOP 14, effectively "shouldering" the pipejoint. The drive ring 40 is then removed and the torque wrench is raised to "make up", or torque, the connection between the new upper IBOP 14 and the drive shaft 12 by rotating the torque tube 38 in direction opposite to that used in breaking out the upper IBOP 10 (FIGS. 11A and B).

Figure 1:
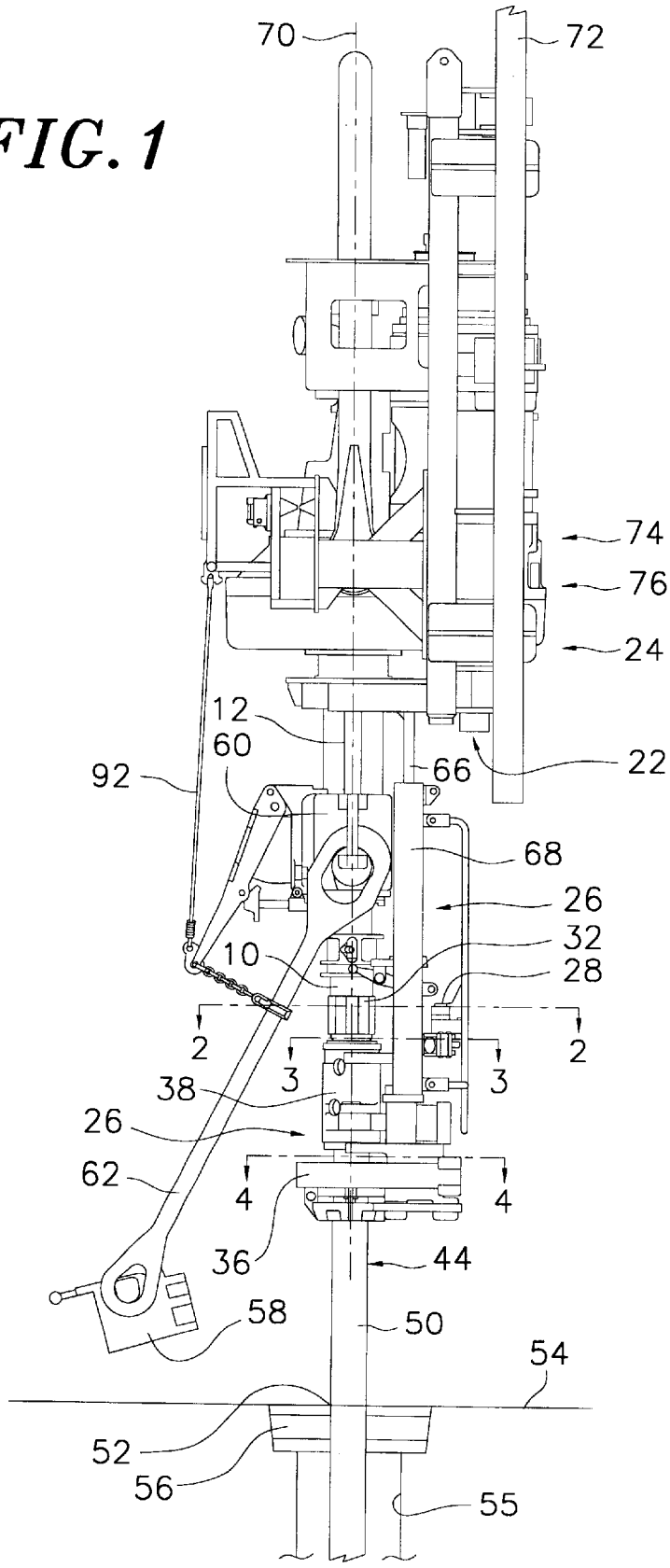
FIG. 1 is a diagrammatic side view of a TDS, a pipe handler and a drill string constructed according to the present invention on an oil rig.

Proceeding now with a more detailed description, a drill string 44 as connected for drilling is shown diagrammatically in FIG. 1. The drill string is threadedly connected to the TDS main drive shaft 12. The drill string is made up of the upper IBOP 10 threadedly connected to a lower IBOP valve (not shown) which itself is further threadedly connected to a saver sub (not shown) which is connected to a drillpipe 50. Each successively higher connection above the drillpipe 50 is tighter than the connections below, so as not to loosen during normal drilling operations. Thus, the connection between the upper IBOP and the lower IBOP is tighter than the connection between the lower IBOP and the saver sub, which in turn is tighter than the connection between the saver sub and the drillpipe. The drillpipe 50 passes through an opening 52 in a drill floor 54 and into a well bore 55. Slips 56 or similar devices can be placed near the opening 52 in order to grip the drillpipe 50 when needed. The rotational force of the drive shaft 12 is transferred downwardly through the drill string 44 to the drill bit (not shown) at the lower end thereof. It will be understood, however, that this particular arrangement is merely an illustrative example and that the invention of the present specification can be used with many other drill string arrangements. For example, the present invention can be used with different combinations of valves, drillpipe joints and drill string accessories.

Referring now specifically to FIG. 1, the pipe handler 20 of the illustrated embodiment is made up of the torque wrench 26, an elevator 58, a carrier body 60 carried by the TDS 24, and links 62 connecting the elevator 58 to the carrier body 60. The pipe handler 20 is supported by the TDS 24, which hangs from a traveling block (not shown) that is used to hoist the TDS 24 up and down. The torque wrench 26 is movably suspended from the TDS 24 by hanger members 66 which, through the use of piston and cylinder mechanisms 68, allow the torque wrench 26 to be moved vertically up and down relative to the TDS 24. The torque wrench 26 utilizes the upper torque tube 38 and a lower gripping section 36. The carrier body 60 is also suspended from the TDS 24.

The TDS 24 is mounted for upward and downward movement along a vertical axis 70 by guide means, preferably taking the form of two spaced vertical tracks or rails 72 extending parallel to the axis 70. The drive shaft 12 is powered by a motor 74 of the TDS 24 to rotate relative to the TDS 24 in either rotary direction. A brake 76 is also provided in order to lock the drive shaft 12 against rotational movement relative to the TDS 24, when desired. An example of such a brake is provided in U.S. Pat. No. 4,437,524 to Boyadjieff et al., which is incorporated by reference in its entirety into the present disclosure. The upper IBOP 10 is attached, either directly or indirectly, to the lower end of drive shaft 12.

Figure 2:
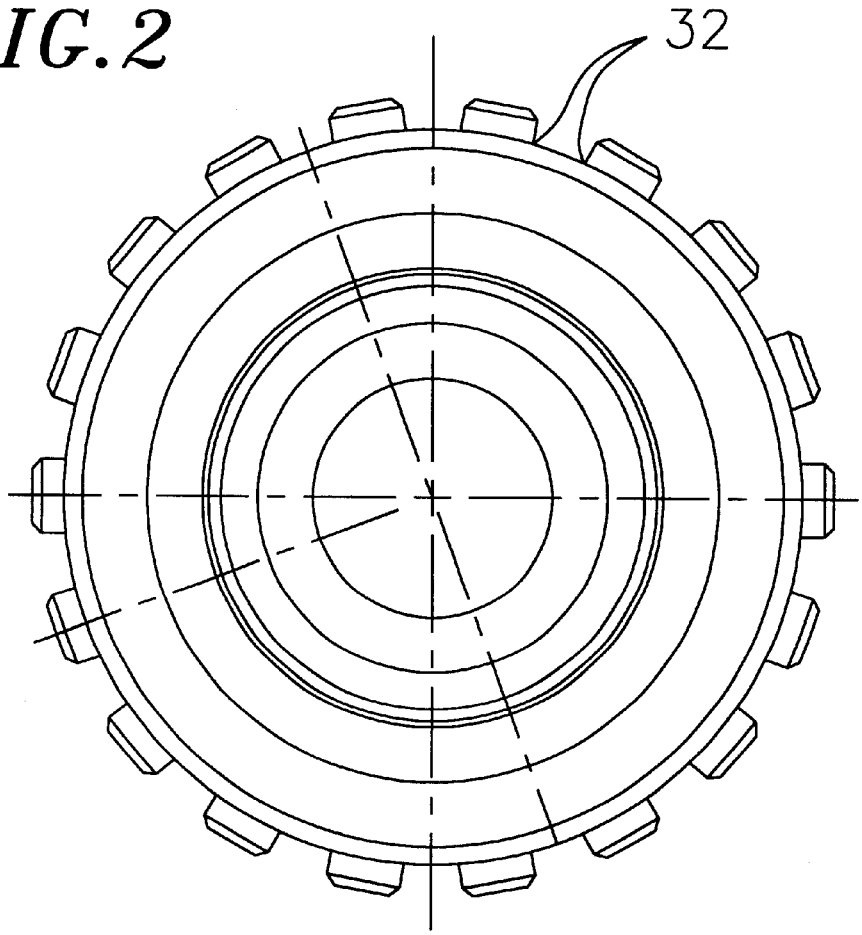
FIG. 2 is a horizontal cross-sectional view of the upper IBOP taken on line 2—2 of FIG. 1 and showing a circular series of axially extending parallel splines along its outer surface.
Figure 3:
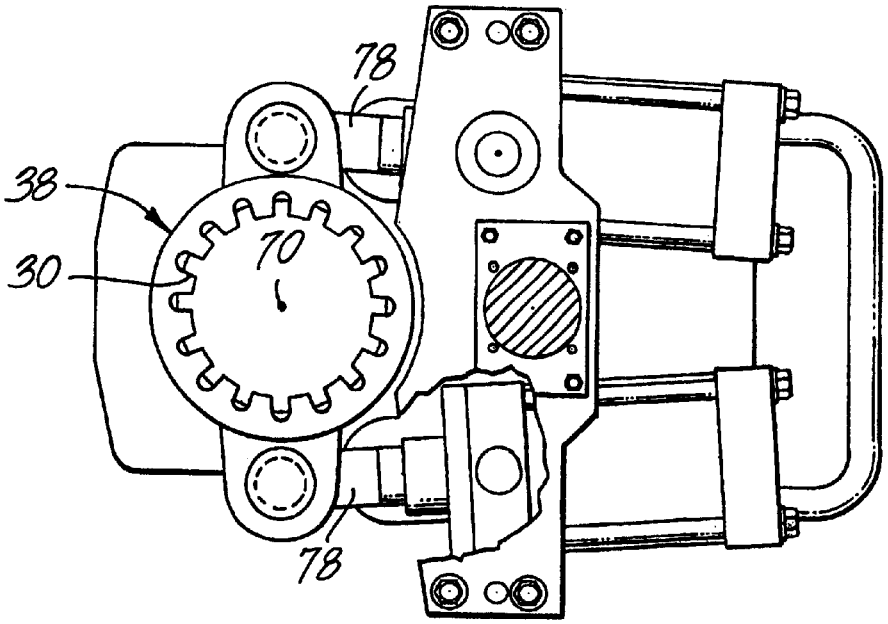
FIG. 3 is a horizontal cross-sectional view of the pipe handler of FIG. 1 taken on line 3—3 of FIG. 1 to show the torque tube assembly of the pipe handler. Also shown are two piston and cylinder mechanisms used to rotate the torque tube.
Figure 4:
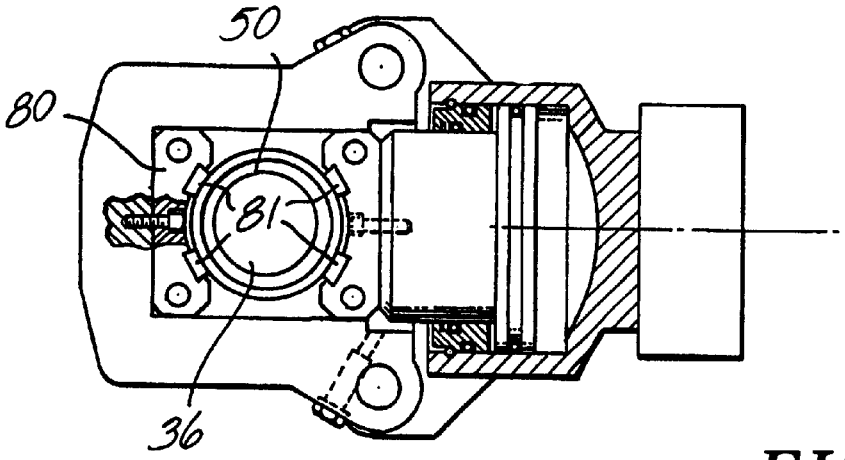
FIG. 4 is a horizontal cross-sectional view of the pipe handler of FIG. 1 taken on line 4—4 of FIG. 1 to show the lower gripping sections of the torque wrench.

FIGS. 1 and 2 illustrate the outer portion of the upper IBOP 10 with its external splines 32, and FIG. 3 shows the torque tube 38 with its complementary internal splines 30. The lower IBOP is similar in construction to the upper IBOP 10. Thus, the torque tube 38 is capable of sliding engagement with either of the IBOP's between an engaged position in which the torque tube rotatably drives the particular IBOP and a disengaged position in which the IBOP is free to rotate relative to the torque tube. FIG. 3 also illustrates two piston and cylinder mechanisms 78 for rotating the torque tube 38, and thus one of the IBOP's, about the vertical axis 70. As shown in FIG. 4, the lower gripping section 36 of the torque wrench 26 has jaws 80 with a plurality of "tong dies" 81 for securely gripping drill string components.

During a drilling operation, the drill string 44 is configured as shown in FIG. 1. The pipe handler 20 (FIG. 6) can then be used as described in U.S. Pat. No. 4,535,852 to Boyadjieff and Krasnov and U.S. Pat. No. 4,449,596 to Boyadjieff, to break out and remove the saver sub and lower IBOP (not shown). This procedure cannot be used to break out and remove the upper IBOP 10 from the drive shaft 12, however, because the torque wrench 26 cannot be pulled up far enough to allow the lower gripping section of the torque wrench 36 to reach the upper IBOP 10. Also, the torque wrenches of the prior art typically do not provide enough rotational force to break out the tightly torqued upper IBOP 10 from the drive shaft 12.

The present invention provides several structural features which combine to permit the apparatus of FIG. 1 to be used to remove the upper IBOP 10 without the need for manual tongs. These features include the air amplifier 22, the hydraulic pressure booster 28, the rotary table back-up structure (RTBS) 16 and the drive ring 40. The air amplifier 22 is added to increase the braking force provided to the brake 76 of the TDS from approximately 100 pounds per square inch to approximately between 175 and 200 pounds per square inch. This increased pressure level is sufficient to prevent the drive shaft from rotating relative to the TDS, even under the torque levels required to break out the upper IBOP 10. The air amplifier used for this purpose can be of conventional design, such as that available from HASKEL INTERNATIONAL of Burbank, Calif.

Figure 5:
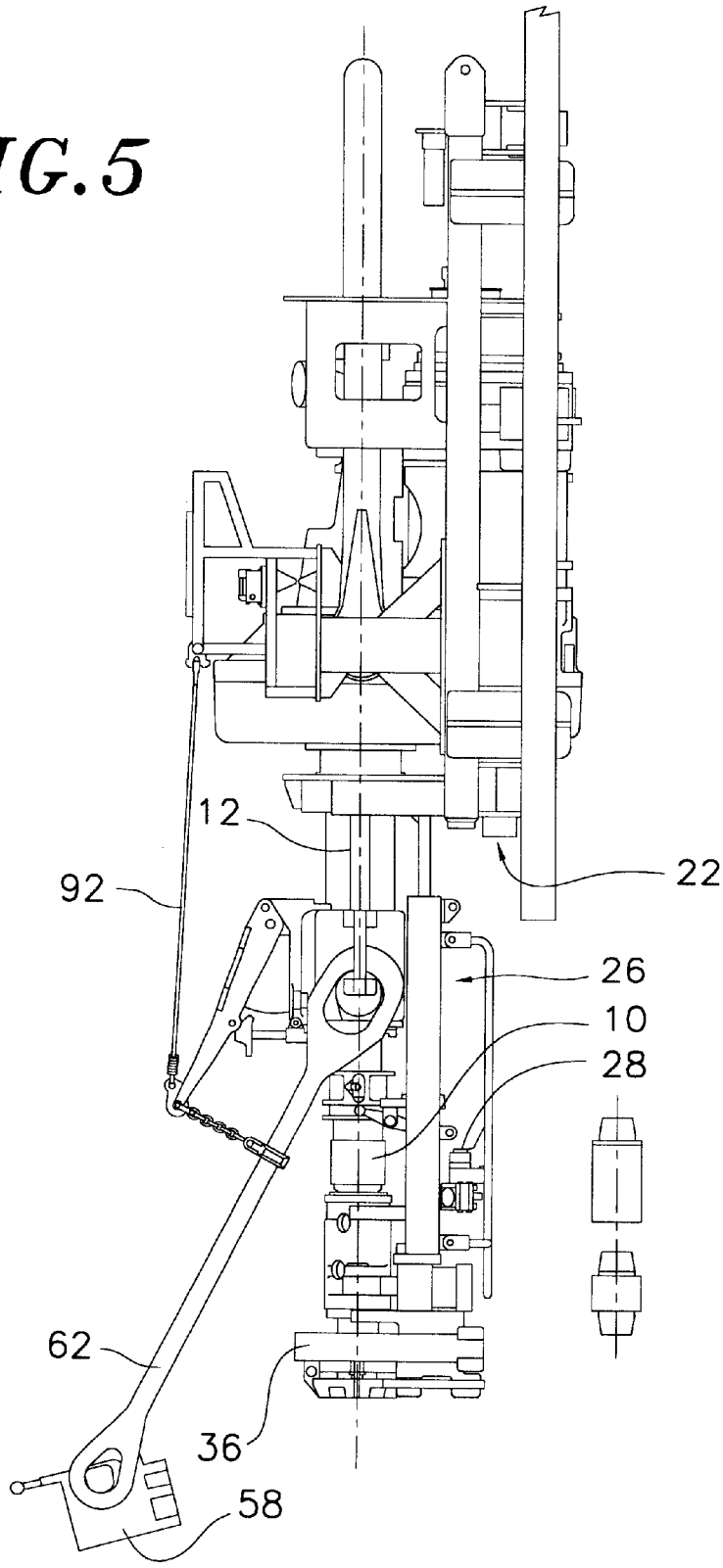
FIG. 5 is a side elevational view of the TDS and pipe handler of FIG. 1 with the drill pipe joint, saver sub and lower IBOP removed. The links 62 and the elevator 58 are shown tied up to the TDS using a tie-up cable.

The hydraulic pressure booster 28, shown in FIG. 5, increases the operating pressure supplied to the torque wrench 26. This results in greater pressure to the lower gripping section of the torque wrench 36 and to the torque tube piston and cylinder mechanisms 78 (FIG. 3). The hydraulic pressure booster 28 boosts the hydraulic pressure from approximately 2000 pounds per square inch to 2500 pounds per square inch. The hydraulic pressure booster 28 can be of conventional design, and is also available from HASKEL INTERNATIONAL of Burbank, Calif.

The RTBS 16 provides the torque back-up required by the torque wrench 26 to break out and retorque the upper IBOP 10. As shown in FIG. 6, the RTBS 16 has a plurality of depending pegs which fit into corresponding openings of the rotary table 18 to lock the RTBS against rotation and maintain the required alignment with the TDS.

The upper end of RTBS 16 has a shoulder 84, also shown in FIG. 6, and a projection 86 shaped to fit inside the upper IBOP 10, as shown in FIG. 7A.

Figure 13A:
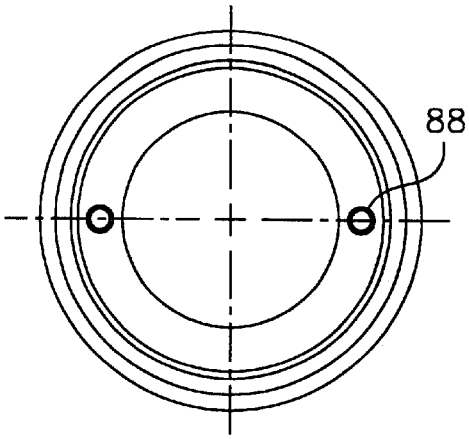
FIGS. 13 A, B and C are top plan, side partial cross-sectional and bottom plan views, respectively, of the drive ring including drive pins.
Figure 13B:
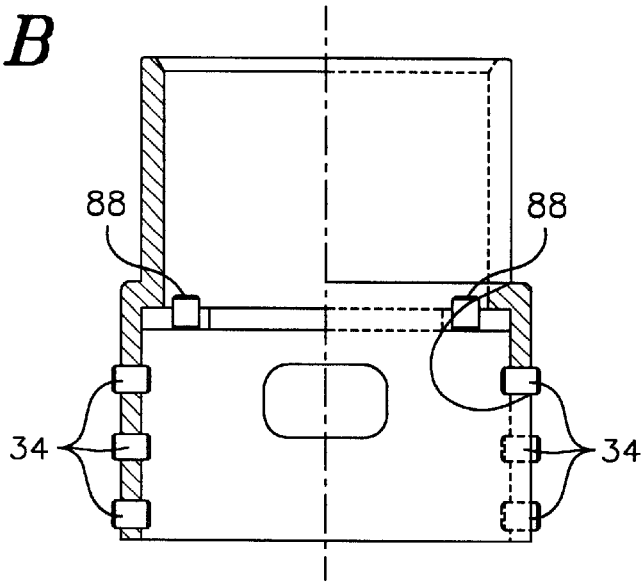
Figure 13C:
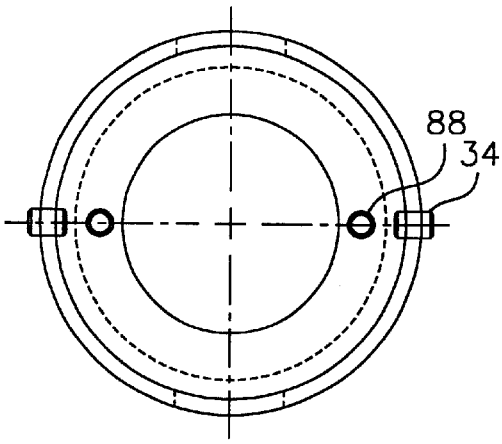

Referring now to FIGS. 8 and 13 A–C, one end of the drive ring 40 fits over the RTBS shoulder 84 with the projection 86 passing through the drive ring 40. Drive pins 88 are used to align the drive ring 40 with shoulder 84 and prevent relative rotation. As shown in FIG. 10, the other end of the drive ring 40 is capable of sliding over the upper IBOP. The drive pins 34 are disposed to fit between the splines 32 of upper IBOP 10 thereby keying those elements together.

Before the upper IBOP 10 can be removed, the links 62 and the elevator 58 must be moved out of the way by tilting them toward the mousehole and tying them up to the TDS 24 using a tie-up cable 92. This is shown in FIG. 5. The RTBS 16 is then secured onto the rotary table 18 and the rotary table 18 is locked in place. The air amplifier 22 is activated to lock the drive shaft 12 against rotational motion by increasing the air pressure to a value between 175 and 200 pounds per square inch.

As shown in FIG. 7A, at this point the TDS 24 and pipe handler 20 are lowered, stabbing the upper IBOP 10 onto the RTBS 16 so that a red stripe 102 on the RTBS 16 aligns with pipe handler 20, as shown. The RTBS 16 serves to stabilize the upper IBOP 10 against lateral motion relative to the vertical axis 70, while allowing the upper IBOP 10 to rotate about the vertical axis 70 and move along the vertical axis 70. The torque wrench 26 is then activated by switching on the hydraulic pressure booster 28 to provide 2500 pounds per square inch of hydraulic pressure. The hydraulic pressure booster is used in breaking out the upper IBOP 10, but is not required to break out the other drilling components because the connections between those elements are not torqued to as high a value as the upper IBOP 10 and the drive shaft 12. In this step, the torque wrench 26 is set to operate in the "make up", or tightening mode. Because the drive shaft 12 is above the upper IBOP 10, the "make up" mode serves to loosen the upper IBOP 10 from the drive shaft 12. The "torque wrench" button is then pressed, causing the torque wrench 26 to rise so that the torque tube splines 30 are brought into overlapping interfitting engagement with the upper IBOP splines 32, and the lower gripping section 36 of the torque tube 38 is caused to grip the RTBS 16, as shown in FIG. 7B. With the air amplifier 22 providing extra air pressure to lock the drive shaft 12 against rotation and the lower gripping section 36 firmly gripping the RTBS 16, the torque tube 38 and the upper IBOP 10 are turned rotatively by the hydraulic pressure supplied to the two piston and cylinder mechanisms 78 (FIG. 3). Like the hydraulic pressure booster 28, the air amplifier 22 is needed only for breaking out the upper IBOP 10 since the prior art air brake provides sufficient force for breaking out the other components. After breaking out the upper IBOP 10, the pressure to torque wrench 26 is released, causing the torque tube to retract from the upper IBOP and release the gripping engagement between the lower gripping section of the torque wrench 36 and the RTBS 16.

Next, as shown in FIG. 8, the TDS 24 and the pipe handler 20 are raised until the pipe handler 20 clears the RTBS 16. The drive ring 40 is then placed over the RTBS shoulder 84 with the projection 86 passing through the drive ring 40. The drive ring 40 is fastened onto the shoulder 84 using the drive pins 88. A thread protector (not shown) can be used in this step to protect the inner threads of the upper IBOP 10 from contact with the RTBS 16.

The torque wrench 26 is then swung back using a tugger line and tied up with a cable 98 as illustrated in FIG. 9. Next, the TDS 24 is lowered so that the upper IBOP 10 fits into drive ring 40, causing the drive pins 34 to engage the slot portions of the axially extending parallel splines 32 on the outer surface of the upper IBOP 10 against rotation. The drive shaft 12 is then unlocked and the TDS motor is activated to spin out the broken out upper IBOP 10 with drive pins 88 and 34 preventing rotational motion of upper IBOP 10. The TDS 24 is again raised, leaving the upper IBOP 10 resting in the drive ring 40. The upper IBOP 10 is then removed from the drive ring 40 as shown in FIG. 10. A new upper IBOP 14 is next placed over the RTBS 16 and the drive ring 40, also as illustrated in FIG. 10. A thread protector 90 can again be used to protect the inner threads of the new upper IBOP 14 from contact with the RTBS 16. The TDS 24 is then slowly lowered with the drive shaft 12 aligned to the new upper IBOP 14. The motor 74 is activated to spin the threads of the drive shaft 12 into engagement with the threads of the new upper IBOP 14, thus "shouldering" the two components.

The drive shaft 12 is again locked. The TDS 24 is raised above the RTBS 16, pulling the new upper IBOP 14 up and out of the drive ring 40. The drive ring 40 is then removed from the RTBS 16 and the cable 98 is released so that the pipe handler 20 can be lowered to the position illustrated in FIG. 11 A, using a tugger line. The TDS 24 and the pipe handler 20 are lowered, stabbing the new upper IBOP onto the RTBS 16 so that the red stripe 102 on the RTBS 16 aligns with the pipe handler 20, as shown. The torque wrench 26 is then activated by switching on the hydraulic pressure booster 28 to provide 2500 pounds per square inch of hydraulic pressure. The torque wrench 26 is set to operate in the "break out", or loosening mode, in order to make up the connection between the drive shaft 12 and the new upper IBOP 14 to the desired torque. Because the drive shaft 12 is located above upper IBOP 10, the "break out" mode serves to tighten the connection between the new upper IBOP 14 and the drive shaft 12.

The "torque wrench" button is then pressed, causing the torque wrench 26 to rise as shown in FIG. 11B, so that the torque tube splines 30 are brought into overlapping interfitting engagement with the new upper IBOP splines 32, and the lower gripping section of the torque wrench 36 is caused to grip the RTBS 16. With the air amplifier 22 providing sufficient air pressure to lock the drive shaft 12 against rotation, and with the lower gripping section 36 firmly gripping the RTBS 16, the torque tube 38 and the new upper IBOP 14 are rotated to torque the upper IBOP 14 onto the drive shaft 12. After making up the upper IBOP 10 in this way, the pressurized fluid to the pipe handler is released, retracting the torque tube 38 out of engagement with the new upper IBOP and releasing the lower gripping section of the torque wrench 36 from the RTBS 16. The TDS 24 and the pipe handler 20 are then raised until the pipe handler 20 clears the RTBS 16.

Figure 12:
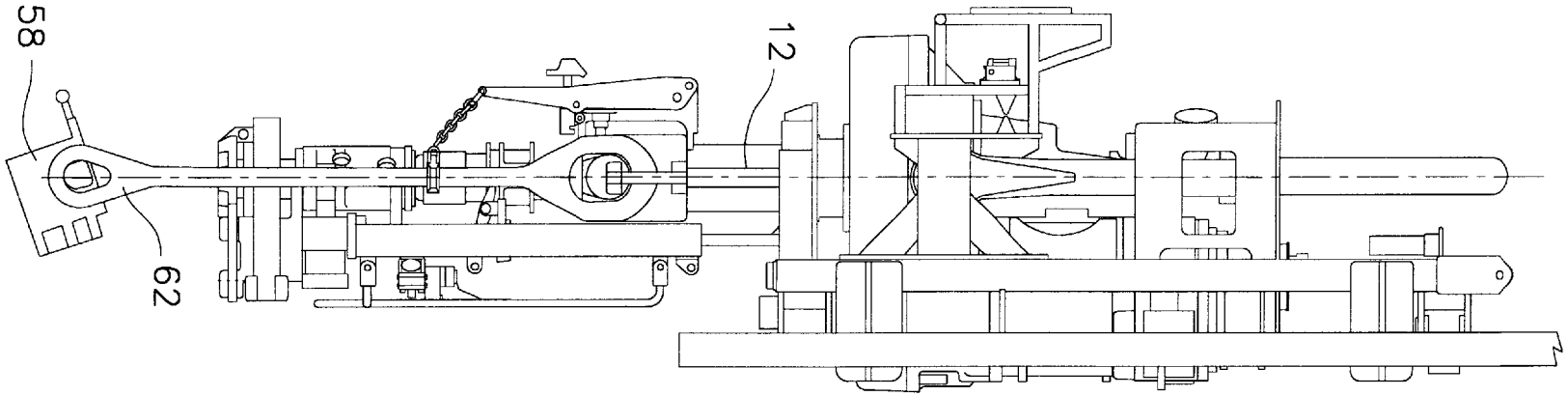
FIG. 12 is a side elevational view of the TDS and pipe handler with the links and the elevator lowered and with the lower IBOP and saver sub replaced.

Next, the rotary table 18 and the drive shaft 12 are unlocked. As shown in FIG. 12, the RTBS is removed from the rotary table 18 and the links 62 and the elevator 58 are untied and lowered back down. The lower IBOP, the saver sub and the drillpipe 50 are then replaced, whereupon drilling operations can be resumed.

While in one embodiment the rotary equipment and IBOP's are arranged as described above, other components and arrangements can be used without deviating from the scope and spirit of the invention. Thus, the apparatus and method of the present invention can be used to remove any piece of equipment that is threadedly connected to the TDS drive shaft 12. Other RTBS shapes and configurations can also be used to provide torque back up for components other than upper IBOP's or differently configured upper IBOP's. For example, the RTBS can serve as a torque back up without actually fitting into the component to be removed. Thus, the RTBS can fit around the component or can be disposed to fit in any other way suitable to stabilize the component. Also, in embodiments where the rig does not have a rotary table, the RTBS can be fastened directly to the rig floor or can be fastened utilizing any other method that will hold the RTBS in place.

The disclosed apparatus and method can be implemented using different drive systems and pipe handler arrangements. Rather than using the disclosed air and hydraulic system, other arrangements for transferring pressure can be added or substituted.

While the above description contains many specific features of the invention, these should not be construed as limitations on the scope of the invention, but rather as an exemplification of one preferred embodiment thereof. Many other variations are possible. Accordingly, the scope of the invention should be determined not by the embodiments illustrated, but by the appended claims and their legal equivalents.

What is claimed is:

1. Apparatus for replacing a drill string component coupled to the drive shaft of a top drive drilling system positioned over a drill floor comprising:

a torque back-up structure engageable in a stationary relationship relative to the drill floor;

a drive shaft brake adapted to substantially prevent rotation of the drive shaft;

a torque wrench adapted to simultaneously grip said torque back-up structure and said drill string component;

said torque wrench operable to apply torque to said drill string component relative to said backup structure to thereby turn said drill string component relative to said drive shaft.

2. The apparatus for replacing a drill string component as recited in claim 1, wherein said torque back-up structure is secured to a rotary table of said drill floor.

3. The apparatus for replacing a drill string component as recited in claim 1, wherein said drive shaft brake includes an air amplifier for increasing the pressure of a source of air pressure for substantially locking the drive shaft against the rotational force required to turn said drill string component relative to the drive shaft.

4. The apparatus for replacing a drill string component as recited in claim 1, wherein said torque wrench is attached to a hydraulic pressure booster providing hydraulic pressure to the torque wrench to turn said drill string component.

5. The apparatus for replacing a drill string component as recited in claim 4, wherein said drill string component is an upper IBOP.

6. The apparatus for replacing, a drill string component as recited in claim 1 wherein said torque back-up structure is secured to an oil rig rotary table and is positioned below said drill string component and said torque wrench.

7. The apparatus for replacing a drill string component as recited in claim 6, wherein said drill string component is disposed to be lowered along a vertical axis and positioned relative to said torque back-up structure so that said torque back-up structure stabilizes said drill string component against lateral motion relative to said vertical axis.

8. The apparatus for replacing a drill string component as recited in claim 1 wherein said torque wrench is comprised of a torque tube and a lower gripping section and wherein said torque tube and said drill string component are structured to allow said torque tube to engage said drill string component in a manner substantially preventing relative rotational motion between said torque tube and said drill string component, and wherein said torque wrench is disposed to be positioned so that said drill string component is placed at least partly within said torque tube when said lower gripping section is in a position to grip said torque back-up structure.

9. The apparatus for replacing a drill string component as recited in claim 1 further comprising a drive ring structured to simultaneously engage said drill string component and said torque back-up structure in order to prevent relative rotational motion between said drill string component and torque back-up structure when connecting and disconnecting said drill string component.

10. The apparatus for replacing a drill string component as recited in claim 9, wherein said drill string component is threadedly connected to said drive shaft and said drive shaft rotates relative to said torque back-up structure, said drive ring and said drill string component in order to connect and disconnect said drill string component from said drive shaft.

11. The apparatus for replacing a drill string component as recited in claim 10, wherein said drill string component is an upper IBOP.

12. A method for replacing a drill string component comprising the steps of:

a) positioning a torque back-up structure so as to stabilize said drill string component;

b) locking a drive shaft using a drive shaft brake in order to prevent rotary motion of said drive shaft;

c) utilizing a torque wrench to simultaneously grip said torque back-up structure and said drill string component;

d) utilizing said torque wrench to apply torque to said drill string component and to turn said drill string component relative to said drive shaft.

13. The method for replacing a drill string component as described in claim 12 further comprising the step of securing said torque back-up structure to a rotary table of a drilling rig.

14. The method for replacing a drill string component as described in claim 12 further comprising the step of providing amplified air pressure produced by an air amplifier in order to substantially lock said drive shaft against the rotational force required to turn said drill string component relative to said locked drive shaft.

15. The method for replacing a drill string component as described in claim 12 further comprising the step of providing hydraulic pressure to said torque wrench in order to turn said drill string component, wherein said hydraulic pressure is produced by a hydraulic pressure booster.

16. The method for replacing a drill string component as described in claim 15 wherein said drill string component is an upper IBOP.

17. The method for replacing a drill string component as described in claim 12 further comprising the steps of:

securing said torque back-up structure to an oil rig rotary table so that it is positioned below said drill string component and said torque wrench; and lowering said drill string component along a vertical axis to a position relative to said torque back-up structure so that the torque back-up structure stabilizes said drill string component against lateral motion relative to said vertical axis.

18. The method for replacing a drill string component as described in claim 12 further comprising the steps of:

positioning said torque wrench so that said drill string component is placed at least partly within a torque tube of said torque wrench in a manner substantially preventing relative motion between said torque tube and said drill string component and simultaneously positioning said torque wrench so that a lower gripping section of said torque wrench grips said torque back-up structure.

19. The method for replacing a drill string component as described in claim 12 further comprising the steps of:

simultaneously engaging said drill string component and said torque back-up structure with a drive ring in order to prevent relative rotational motion between said drill string component and torque back-up structure when connecting and disconnecting said drill string component from said drive shaft.

20. A method for replacing a drill string component comprising the steps:

a) securing an RTBS onto a rotary table, directly below an upper IBOP, pipe handler and a TDS;

b) activating an air amplifier in order to substantially lock a TDS drive shaft against rotational movement;

c) lowering said TDS, pipe handler, and upper IBOP so as to stab said upper IBOP onto said RTBS;

d) activating a torque wrench, comprising a torque tube and a lower gripping section, to rise up so that torque tube splines and slots engage upper IBOP splines and slots and so that said lower gripping section of said torque wrench grips said RTBS utilizing hydraulic pressure produced by a hydraulic pressure booster;

e) breaking-out said upper IBOP from said drive shaft by rotating said torque tube utilizing said hydraulic pressure booster to provide hydraulic pressure and utilizing said RTBS and said substantially locked drive shaft as torque back-ups;

f) raising said TDS and pipe handler to lift said upper IBOP off of said RTBS;

g) placing a drive ring over said RTBS, said drive ring having drive pins, and swinging said torque wrench out of the way so as to allow lowering said upper IBOP so that said drive pins engage slot portions running along the outside of said upper IBOP;

h) unlocking said drive shaft;

i) activating said TDS to spin out said upper IBOP from said drive shaft;

j) raising said TDS so as to leave said upper IBOP resting in said drive ring;

k) removing said upper IBOP from said drive ring;

l) placing a new upper IBOP into said drive ring so that slot portions running along the outside of said new upper IBOP engage said pins;

m) lowering said TDS so as to bring said drive shaft into contact with said new upper IBOP;

n) activating said TDS to spin said drive shaft into said new upper IBOP;

o) raising said TDS and pipe handler to lift said new upper IBOP out of said drive ring;

p) removing said drive ring from said RTBS;

q) lowering said TDS, pipe handler, and new upper IBOP so as to stab said new upper IBOP onto said RTBS;

r) activating said torque wrench to rise up so that said torque tube splines and slots engage new upper IBOP splines and slots and so that said lower gripping section of said torque wrench grips said RTBS utilizing hydraulic pressure produced by a hydraulic pressure booster;

s) making-up said new upper IBOP to said drive shaft by rotating said torque tube utilizing said hydraulic pressure booster to provide hydraulic pressure and utilizing said RTBS and said substantially locked drive shaft as torque back-ups.

* * * * *

UNITED STATES PATENT AND TRADEMARK OFFICE

CERTIFICATE OF CORRECTION

PATENT NO. : 6,276,450 B1
DATED : August 21, 2001
INVENTOR(S) : Padmasiri Daya Seneviratne It is certified that error appears in the above-identified patent and that said Letters Patent is hereby corrected as shown below:

Column 9,
Line 12, after "replacing" delete the comma.

Signed and Sealed this

Fourth Day of February, 2003

JAMES E. ROGAN
*Director of the United States Patent and Trademark Office*